United States Patent [19]

Mashaw, Jr.

[11] Patent Number: 4,915,175

[45] Date of Patent: Apr. 10, 1990

[54] WELL FLOW DEVICE

[75] Inventor: Howard R. Mashaw, Jr., Carrollton, Tex.

[73] Assignee: Otis Engineering Corporation, Dallas, Tex.

[21] Appl. No.: 313,598

[22] Filed: Feb. 21, 1989

[51] Int. Cl.[4] ..... E21B 34/14

[52] U.S. Cl. ..... 166/332; 166/115; 166/131; 166/184; 166/240; 166/324

[58] Field of Search ..... 166/334, 324, 332, 114, 166/115, 116, 237, 240, 331, 131, 149, 184

[56] References Cited

U.S. PATENT DOCUMENTS 3,051,243 8/1962 Grimmer et al. ..... 166/332

3,151,681 10/1964 Cochran ..... 166/332

3,395,758 8/1968 Kelly et al. ..... 166/332 X 4,462,465 7/1984 Strickland ..... 166/332 X

*Primary Examiner*—Hoang C. Dang

*Attorney, Agent, or Firm*—Johnson & Gibbs

[57] ABSTRACT

A sliding sleeve valve well flow control device having a tubular nipple connectable in a well tubing string and side ports for flow into the nipple and a retrievable pack-off sleeve insertable into the nipple for closing the side ports, the sleeve including an equalizing port and J-slots for coacting with a guide lug in the nipple to position the sleeve at an equalizing position prior to retrieving the sleeve from the nipple to minimize the damage to seals around the retrievable sleeve.

5 Claims, 1 Drawing Sheet

WELL FLOW DEVICE

FIELD OF THE INVENTION

This invention relates to well tools, and more particularly relates to a sliding sleeve type valve for inclusion in a well tubing string including a retrievable internal sleeve.

BACKGROUND OF THE INVENTION

Oil and gas wells are generally fitted with well bore casing, liner, and fluid production tubing strings for flowing petroleum oil, and gas from an earth formation through the well bore to the surface. In such wells, the tubing string or strings define flow paths through which well fluids may flow while the annulus between the tubing string or strings and the well casing defines an additional flow path which may serve to conduct well fluids to the surface or may contain static liquids for maintaining a hydrostatic head in the well for well known flow control purposes. The tubing strings used in such wells are made up of the necessary number of tubing joints connected together end-to-end to provide communication downwardly in the well from the surface to the desired producing zone.

It is well known practice to include in tubing strings a sliding sleeve type valve having side ports for communicating the bore of the tubing string with the annulus between the tubing string and the well casing. Such sliding sleeve flow control devices may be used to direct flow from the tubing to the casing, or from the casing to the tubing by plugging the tubing below the ports. If desired, flow may occur both within the tubing from below the ports and from the casing annulus into the tubing simultaneously. Circulation and production flow control devices are available with permanently installed internal sleeve valves and with removable sleeve valves. Also, available are solid sleeves sometimes referred to as isolation or pack-off sleeves. The sleeve valve members normally have external annular spaced seals installed in recesses around the sleeves for sealing between the nipple bore surfaces and the sleeve on opposite sides of side ports through the nipple into the annulus. A particular problem with such seals has been encountered when removing a sleeve valve under substantial pressure differentials between annulus and the tubing bore. The seals have been often severely damaged and may be blown out of the recesses around the sleeve when the sleeve moves in the nipple to a bore portion sufficiently enlarged to allow extrusion of the seal.

It is a principal object of the invention to provide a new and improved well flow control device.

It is another object of the invention to provide a well flow control device includable in a well tubing string of a well.

It is another object of the invention to provide a well flow control device of the sliding sleeve type.

It is another object of the invention to provide a sliding sleeve type valve having a retrievable internal sleeve releasably lockable in the nipple of the valve.

It is an especially important object of the invention to provide a retrievable sleeve for a sliding sleeve valve which includes means for equalizing the pressure between the tubing string bore and the well annulus.

It is a still further object of the invention to provide a retrievable pack-off sleeve for a sliding sleeve valve which includes a slot and lug arrangement for locking the retrievable sleeve at a flow equalizing position preliminary to removal of the sleeve from the nipple.

In accordance with the invention there is provided a sliding sleeve valve for a well production tubing string including a tubular landing nipple connectable at opposite ends with tubing joints making up the tubing string, the landing nipple having side flow ports, equalizing ports spaced from the flow ports, a locking and guide lug projecting into the bore of the nipple, and an internal annular latching recess. A retrievable isolation sleeve adapted to fit in the landing nipple and block flow through the side ports of the nipple includes spaced external annular seals located at opposite sides of the nipple side ports when the sleeve is installed in the nipple, equalizing ports in the sleeve positioned for alignment with the equalizing port in the nipple prior to movement of the sleeve seals into larger bore portions of the nipple when removing the sleeve, external J-slots formed in the outer surface of the sleeve for coaction with the nipple lug to guide the sleeve to equalizing, locking, and release positions in the nipple, and latching collet fingers formed in the sleeve for releasably locking with the locking recess in the nipple to latch the sleeve in operating position in the nipple.

Additional objects and advantages of the present invention will be better understood from the following detailed description of a preferred embodiment thereof in conjunction with the accompanying drawings.

BRIEF DESCRIPTION OF THE DRAWINGS

Referring to FIG. 1, a well bore 10 is lined with a casing 11 provided with flow ports 12. A production tubing string 13 is installed in the casing connected with a packer 14 sealing between the tubing string and the casing wall above the flow ports 12. A sliding sleeve valve 15 embodying the features of the invention is included in the tubing string above the packer to provide communication between the tubing string and an annulus 20 in the casing between the casing and the tubing string. Flow between the annulus 20 and the tubing string bore may be permitted when ports or the sliding sleeve valve 15 are open and flow is shut off when an isolation sleeve in accordance with the invention is installed in the nipple of the sliding sleeve valve shutting off flow through sliding sleeve valve ports.

Referring to FIG. 2, the sliding sleeve valve 15 of the invention includes a housing or nipple 21 and a retrievable internal isolation sleeve 22. The nipple 21 is a tubular housing member threaded at opposite ends at 23 and 24 for connection with the tubing joints making up the tubing string 13. The nipple 21 has circumferentially spaced flow ports 25 for communication between the bore of the nipple and the annulus in a well bore around the tubing string. To facilitate flow into the nipple, the bore of the nipple is enlarged along a section 30 extending along and above and below the flow ports 25. The nipple bore has seal surfaces 31 and 32 above and below the flow ports. Below the flow ports the nipple is provided with equalizing ports 33 which communicate through the nipple with the nipple bore. A guide lug 34 is secured through the nipple wall and has an inward end portion projecting into the bore of the nipple. An internal annular stop shoulder 35 is provided in the nipple bore limiting the downward movement of the sleeve 22 in the nipple. Below the stop shoulder 35, the nipple has an internal annular latching or locking recess 40. The retrievable isolation sleeve 22 has a fishing neck 50 along an upper end portion provided with an internal annular recess 51 for engagement of wireline running and pulling tools for installing and retrieving the isolation sleeve. External annular seals 52 and 53 are provided on the sleeve spaced to span the flow ports 25 in the nipple when the sleeve is installed to block flow from the ports into the bore of the nipple. A third wiper seal 54 is installed on the isolation sleeve below the seal 53. Equalizing ports 55 are provided in the isolation sleeve below the seal 53 spaced along the sleeve for alignment with the equalizing ports 33 of the nipple prior to movement of the sleeve seals 52 and 53 into the larger bore portions of the nipple during the retrieving of the sleeve. The sleeve 22 is provided with a continuous J-slot pattern 60 cut into the sleeve surface and circumferentially surrounding the sleeve with a plurality of inverted J-slots of conventional shape having first upper locking portions 61, second equalizing portions 62, and third exit portions 63. Other J-slot portions 64, 65, 66, and 67 function as described below. Such J-slots patterns are typical in oil and gas well tools which include internal parts requiring rotation and locking within a housing as the part is raised and lowered. The J-slot configuration includes sloping surfaces such as 64 and 65 which provide a cam effect causing the sleeve to rotate as it is reciprocated during installation, equalizing, and retrieval of the sleeve. The inward end portion of the guide lug 34 secured through the nipple projects into the J-slot configuration coacting with the J-slot portions for rotating the sleeve between insertion, pack-off, equalizing, and release positions. A plurality of circumferentially spaced longitudinal collet fingers 70 having external collet bosses are provided in the sleeve below the J-slots for engagement with the latch recess 40 in the nipple to latch the isolation sleeve at the isolation position illustrated in FIG. 2.

Figure 1:
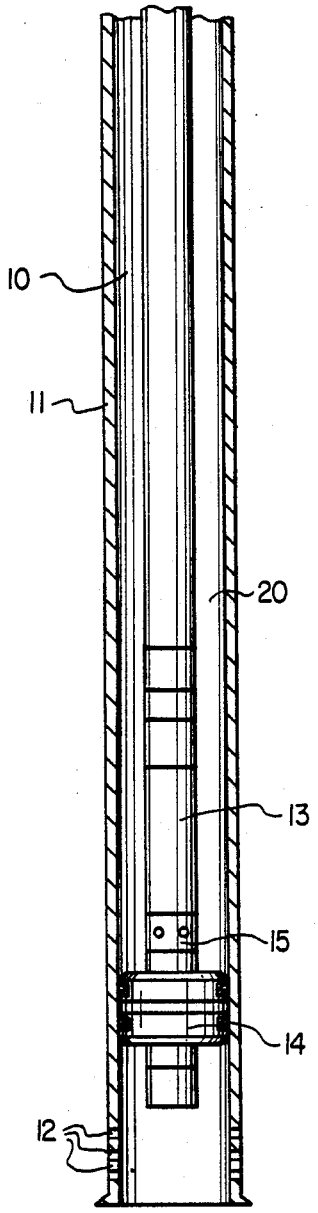
FIG. 1 is a schematic view of a section of a well completed with a well packer and a production tubing string including a sliding sleeve valve in the tubing string above the packer.
Figure 2:
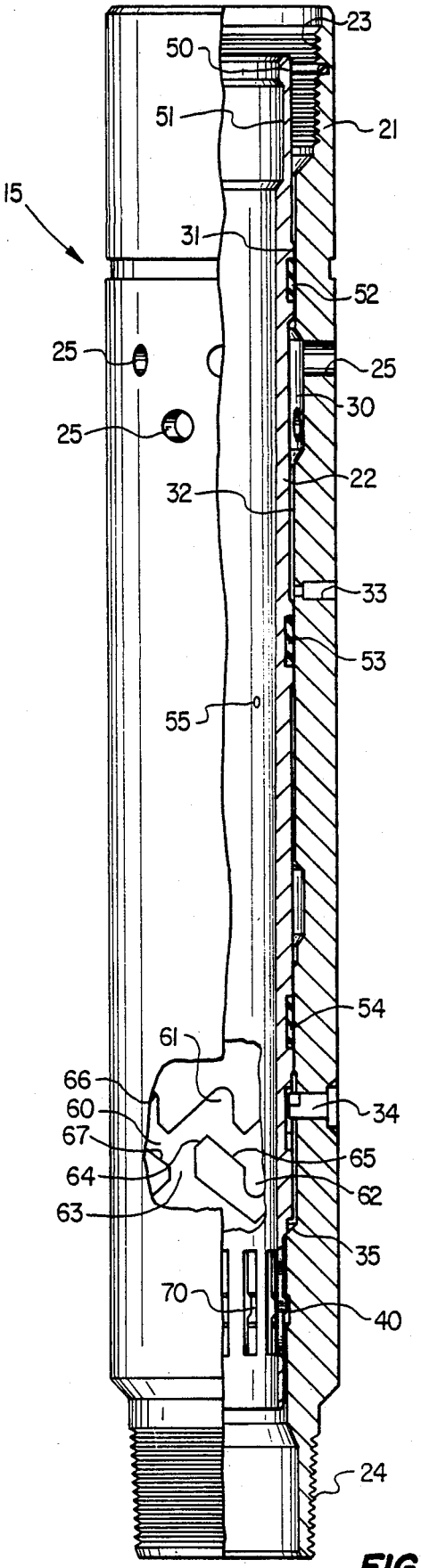
FIG. 2 is a longitudinal view in section and elevation of a sliding sleeve valve in accordance with the invention showing the isolation sleeve of the valve at a closed or pack-off position.

In operation, the retrievable sleeve device 15 is connected in the tubing string 13 which is then run into the well bore 10 where the packer 14 is set to engage and seal within the inner wall of the casing 11. The device 15 is connected in the tubing string by securing the pipe sections forming the tubing string above and below the device 15 with the threads 23 and 24, respectively, of the nipple 21, forming the housing of the device. The retrievable sleeve 22 may be installed in the nipple 21 at the surface and run with the tubing string, or alternatively, the sleeve may be installed at a later time when it is desired to block flow through the nipple ports 25 into the tubing string. If installed at a later time, suitable standard wireline techniques and equipment are employed to lower the sleeve 22 through the tubing string into the nipple 21 and latch the sleeve in place as illustrated in FIG. 2. Typical wireline equipment and techniques are described and illustrated at pages 281–314 of the 1985 edition of the General Sales Catalog of Otis Engineering Corporation. In using the wireline equipment to run the sleeve into the well, a running tool, not shown, is coupled with the fishing neck 50 of the sleeve 22 engaging the recess 51 in the fishing neck for holding the sleeve on the running tool. The sleeve is lowered through the tubing string into the nipple until the stop shoulder 35 in the nipple is engaged by the sleeve and the collet fingers 70 are latched in the nipple recess 40. As the sleeve moves downwardly in the nipple the guide lug 34 in the nipple engages the J-slot configuration 60 rotating the sleeve to an insertion position; entering through the recess portion 63. The sloping surfaces in the J-slot configuration rotate and guide the sleeve to a pack-off position at which the lug 34 occupies an upper J-slot portion 61 of the sleeve with the collet fingers releasably latching the sleeve in the nipple. The sleeve seals 52 and 53 engage the seal surfaces 31 and 32, respectively, within the nipple 21 sealing at opposite sides of the ports 25 so that flow from the well annulus cannot flow into the tubing string. Any production, thus, will flow upwardly in the tubing string from below the device 15.

When removal of the retrievable sleeve is desired, either to replace the seals or otherwise service or repair the sleeve, or alternatively, when removal of the sleeve is desired to establish circulation from the well annulus through the ports 25 into the production tubing, a wireline pulling tool, not shown, is lowered through the tubing to again grasp the fishing neck for pulling the sleeve. In accordance with the invention, after the pulling tool is engaged with the fishing neck of the sleeve, the sleeve is pulled up relative to the nipple so that the guide lug 34 engages the J-slot surface 65 camming the sleeve around to a position at which the lug 34 enters the lower end portion 62 of the J-slot configuration which limits the upward movement of the sleeve to an equalizing position at which the equalizing ports 55 in the sleeve are aligned with the equalizing port 33 in the nipple and the lower sleeve seal 53 is above the equalizing port 33 so that pressure is equalized between the annulus and the bore of the sleeve. During the equalizing step the lug 34 is holding the sleeve in the J-slot configuration against any farther movement upwardly in the nipple with the seals 52 and 53 remaining in restricted bore portions of the nipple along seal surfaces so that flow from the ports 25 does not tend to flow-cut the seals or extrude them from the recesses in which they are disposed around the sleeve. When the pressure is equalized between the annulus and the tubing string bore, the wireline tool is jarred back downwardly causing the guide lug 34 to rotate the sleeve to a position at which the lug is in the J-slot portion 66 at which time the sleeve is pulled back upwardly by the pulling tool with the lug 34 engaging the cam surface 67 along the J-slot further rotating the sleeve to a release positioning aligning the lug 34 with the entrance and exit portions 63 of the J-slot thereby releasing the sleeve from the lug 34. The collet fingers 70 cam inwardly from the recess 40 of the nipple releasing the sleeve from the nipple. The sleeve is then pulled upwardly to the surface. The equalizing of the pressures between the annulus and the bore prior to actually fully releasing the sleeve from the nipple prevents the sleeve from being blown upwardly and the seals on the sleeve from being damaged.

It will now be seen that a new and improved well flow device in the form of a sliding pack-off sleeve having an pressure equalizing feature is installed in and removed from a landing nipple by use of wireline equipment with no damage or minimum damage to the sleeve seals.

What is claimed is:

1. A sliding sleeve valve for connection in a tubing string of a well for controlling flow between the annulus of said well and the bore of said tubing string comprising:

a tubular nipple having a longitudinal bore therethrough and threads at opposite ends thereof for connection with and between adjacent pipe joints forming said tubing string, said nipple having side flow ports for flow from said annulus of said well into said bore of said nipple, internal seal surfaces along said bore of said nipple on opposite sides of said ports, an equalizing port through said nipple into said bore toward an input end of said nipple from said side flow ports, an internal annular stop shoulder in said nipple toward said input end from said equalizing port, and an internal annular latch recess toward said input end of said nipple from said stop shoulder;

a guide lug secured through said nipple extending into said bore of said nipple between said stop shoulder and said equalizing port; and a retrievable pack-off sleeve sized to fit in said bore of said nipple, said pack-off sleeve having radially movable collet fingers formed along a lower end portion of said sleeve and engageable with said latch recess in said nipple for releasably locking said sleeve in said nipple, an external annular stop shoulder on said sleeve engageable with said stop shoulder in said nipple for limiting downward movement of said sleeve in said nipple, an external latching and operating recess means formed in the outer surface of said sleeve for coaction with said guide lug of said nipple for rotating said sleeve and operating said sleeve between insertion, pack-off, equalizing, and release positions in said nipple; and annular seal assemblies on said sleeve positioned to engage said seal surfaces of said nipple bore at a location in said nipple bore at which said flow ports and said equalizing port of said nipple are between said seal assemblies on said sleeve and said sleeve is provided with equalizing port means alignable with said equalizing port in said nipple at said equalizing position of said sleeve and misaligned from said nipple equalizing port on the side of one of said annular seal assemblies on said sleeve toward said stop shoulder when said sleeve is in said pack-off position in said nipple.

2. The well device of claim 1 wherein said seals on said sleeve are positioned to remain engaged with seal surfaces along said nipple bore when said sleeve is at said equalizing position in said nipple.

3. The well flow device of claim 2 wherein said latching and operating recess means around said retrievable sleeve is a J-slot configuration on said sleeve for engagement by said guide lug of said nipple, said J-slot configuration having entry and release portions, latch portions holding said sleeve at said equalizing position when said sleeve is pulled upwardly, and sloping cam surfaces for rotating said sleeve between said insertion, pack-off, equalizing, and release positions responsive to upward and downward movements of said sleeve.

4. A well flow device in accordance with claim 3 including a fishing neck having an internal annular recess along the upper end portion of said sleeve.

5. A well flow device in accordance with claim 4 including an external annular wiper seal on said sleeve between said equalizing port in said sleeve and said J-slot configuration around said sleeve.

* * * * *